US008220540B2

(12) United States Patent
Freyer

(10) Patent No.: US 8,220,540 B2
(45) Date of Patent: Jul. 17, 2012

(54) APPARATUS AND METHODS FOR ESTIMATING LOADS AND MOVEMENTS OF MEMBERS DOWNHOLE

(75) Inventor: Carsten Freyer, Lower Saxony (DE)

(73) Assignee: Baker Hughes Incorporated, Houtson, TX (US)

( * ) Notice: Subject to any disclaimer, the term of this patent is extended or adjusted under 35 U.S.C. 154(b) by 0 days.

(21) Appl. No.: 11/836,953

(22) Filed: Aug. 10, 2007

(65) Prior Publication Data

US 2008/0035376 A1 Feb. 14, 2008

Related U.S. Application Data

(60) Provisional application No. 60/837,054, filed on Aug. 11, 2006.

(51) Int. Cl.
*E21B 47/007* (2012.01)

(52) U.S. Cl. ..... 166/250.01; 175/27; 175/40; 175/45

(58) Field of Classification Search ..... 175/27, 175/40, 45, 328; 166/250.01
See application file for complete search history.

(56) References Cited

U.S. PATENT DOCUMENTS

| | | | | |
|---|---|---|---|---|
| 3,059,707 | A * | 10/1962 | Frisby | 175/44 |
| 5,410,303 | A * | 4/1995 | Comeau et al. | 340/853.3 |
| 6,581,480 | B1 | 6/2003 | May et al. | |
| 6,615,949 | B1 | 9/2003 | Egerev et al. | |
| 6,871,555 | B2 | 3/2005 | May | |
| 6,904,814 | B2 | 6/2005 | May | |
| 6,910,391 | B1 | 6/2005 | May | |
| 2002/0108784 | A1 * | 8/2002 | Kruspe et al. | 175/40 |
| 2005/0150689 | A1 | 7/2005 | Jogi et al. | |
| 2005/0193834 | A1 | 9/2005 | May | |
| 2007/0017705 | A1 * | 1/2007 | Lasater | 175/61 |

FOREIGN PATENT DOCUMENTS

| | | | |
|---|---|---|---|
| WO | 9956099 | | 11/1999 |
| WO | 02063262 | A1 | 8/2002 |
| WO | 2005064623 | | 12/2004 |
| WO | 2005064281 | | 7/2005 |
| WO | 2005064301 | | 7/2005 |
| WO | 2005064302 | | 7/2005 |
| WO | 2005064303 | | 7/2005 |
| WO | WO2005/064302 | * | 7/2005 |

OTHER PUBLICATIONS

May, Lutz; Revolution anstatt Evolution; pp. 24-25.
May, Lutz; Kraft-und Positionssensor mit 4mm; pp. 36-37.
May, Lutz; Wo niemand zuvor gemessen hat; pp. 130-131.

* cited by examiner

*Primary Examiner* — Cathleen Hutchins
(74) *Attorney, Agent, or Firm* — Cantor Colburn LLP

(57) ABSTRACT

This disclosure, in one aspect, provides an apparatus for use in a wellbore that includes a member having an encoded magnetic field and a sensor proximate the encoded magnetic field that measures a change in the magnetic field due to a change in the load on the member. In another aspect, a method for measuring loads on a downhole tool is provided that comprises inducing an encoded magnetic field along a section of a member of the tool and detecting a change in the magnetic field due to a load on the member when the tool is in the wellbore.

16 Claims, 6 Drawing Sheets

APPARATUS AND METHODS FOR ESTIMATING LOADS AND MOVEMENTS OF MEMBERS DOWNHOLE

CROSS REFERENCE TO RELATED APPLICATIONS

This Application takes priority from U.S. Provisional Patent Application Ser. No. 60/837,054, filed on Aug. 11, 2006, which is fully incorporated herein by reference.

FIELD OF THE DISCLOSURE

This disclosure generally relates to apparatus and methods relating to wellbore operations, including determining loads on and movements of portions of tools.

BACKGROUND INFORMATION

To obtain hydrocarbons such as oil and gas, wells (also referred to as "wellbores" or "boreholes") are drilled by rotating a drill bit attached at a drill string end. A large number of the current drilling activity involves directional drilling, i.e., drilling deviated and horizontal boreholes, to obtain increased hydrocarbon production from subsurface formations. Such wellbores are often drilled along complex well paths. The systems used to drill such wellbores generally employ a drill string that has a drilling assembly (also referred to as a "bottomhole assembly" (BHA)) and a drill bit at an end thereof. The drill bit is rotated by rotating the drill string from the surface and/or by rotating the drill bit by a drilling motor (also referred to as the "mud motor") disposed in the drilling assembly. A drilling fluid (commonly known as the "mud" or "drilling mud") is pumped into a tubing of the drill string to rotate the drilling motor and the tubing is rotated by a prime mover at the surface, such as a motor. The drill bit is typically coupled to a bearing assembly having a drive shaft which in turn rotates the drill bit attached thereto. Radial and axial bearings in the bearing assembly provide support to the radial and axial forces of the drill bit.

A number of devices and sensors carried by the BHA measure various parameters or characteristics associated with the drill string. Such devices typically include sensors for measuring pressure, temperature, azimuth, inclination, vibration, etc. The BHA also includes a variety of other devices or sensors, such as resistivity, acoustic, nuclear, nuclear magnetic resonance sensors, etc., which devices are commonly referred to a "measurement-while-drilling" ("MWD") or logging-while-drilling ("LWD") tools or sensors. MWD sensors are used to determine properties of the earth formation and the extent of the hydrocarbons contained in the formation. These devices and sensors contain complex and sensitive sensors and electronic components, which may remain disposed in the wellbore for several hours to days.

The BHA, during drilling of a wellbore, is subjected to varying load conditions, which may be due to bending moments exerted on various elements of the BHA by side forces acting on the BHA, vibration, weight on bit, etc. These forces can be caused by gravity, drilling dynamic effects and/or by contact between the wellbore wall and the BHA. The bending moments can cause deviations from the desired wellbore path. It is therefore desirable to measure loads on one or more components of the BHA and the movement or displacement of certain elements of the BHA with respect to fixed points or relative to other members so that actions may be taken to maintain the BHA within certain operating limits during drilling of the wellbore.

The disclosure herein provides apparatus and method for estimating loads and other parameters of interest relating to a wellbore operation.

SUMMARY

In one aspect, an apparatus for estimating a property of a tool downhole is disclosed that includes a member having a magnetic coded field section and at least one sensor that detects a change in the magnetic field downhole, such as due to a load or motion associated with the member. In one aspect, the sensor may include at least one coil proximate the coded magnetic field. In one embodiment, the member may be a rotating member and the sensor may be located in a non-rotating or substantially non-rotating member.

The apparatus, in one aspect, may include a circuitry that conditions the sensor signals. The sensor signals may be processed in part or whole by a downhole processor to determine the property of interest, such as a on the tool or movement of one component relative to another component or a fixed point. The load may be due to torque, axial movement, such as caused by compression, tension or bending. The processed signals may be sent to a surface controller for further processing either while drilling the wellbore or after retrieval of the drill string to the surface. A computer-readable storage medium, such as a solid-state memory device, associated with the processor may store data, information, computer programs, algorithms and models for use by the processor during drilling of the wellbore. The processor, in one aspect, communicates bi-directionally with the surface controller via a suitable telemetry scheme. In one aspect, the processor may activate a device downhole based at least in part on the measurements made by a sensor. In one aspect, the sensor measurements provide information about the bend of a member that may be used in a closed-loop manner to control the direction of drilling of a wellbore.

In another aspect, a magnetic sensor arrangement may provide measurements related to movement of a member of a downhole tool. In one aspect, a first member may include a magnetic coded section and a second member may carry one or more sensors that detect changes in the magnetic field of the coded magnetic field section due to movement of one or both members. The movement may be linear or angular. In one aspect, a section of a surface of a piston that moves a force application member outward (radially) may be magnetically coded and a stationary member proximate the piston surface may be configured to carry a sensor. Multiple pistons and associated force application members may be used to determine the internal diameter or the dimensions of the wellbore from the movement measurements made by the sensors. In another aspect, a rotating member may be coded with the magnetic field and the sensors may be carried by the non-rotating member, wherein the sensors detect changes in the magnetic field when one member rotates with respect to the other member. The change in the magnetic fields provides the angular movement of one member with respect to the other member. The angular movement may also be used to determine the rotational speed of one of the members.

In another aspect, a method for estimating a parameter of interest downhole, including load on and/or movement of a member of a tool is disclosed. The method, in one aspect, includes encoding a magnetic field along a section of a member of the tool and detecting a change in the magnetic field due to a load on the member downhole. In one aspect, the method includes providing a signal that corresponds to the detected change in the magnetic field and processing the signal to estimate a parameter of interest, which may be torque, axial movement, bend or weight on bit of a drilling assembly. In another aspect, a method for estimating movement of a first member with respect to a second member is disclosed. The method includes magnetically coding a section of the first member and placing at least one sensor on the second member proximate the magnetic coding, and detecting a change in the magnetic field when one or both members move relative to each other. The movement may be angular or axial. The method further may include providing a signal corresponding to the detected change and processing the signal to estimate the movement of a member. The method further may comprise transmitting information to the surface and/or storing the information at a downhole memory. In another aspect, the method may include controlling an operation of a device downhole at least in part in response to the processed signals. In another aspect, the method may include using information from an additional sensor to control the operation of the device. The additional sensor may include a directional sensor, resistivity sensor, an accelerometer, a gamma ray sensor, an NMR sensor, an acoustic sensor, a pressure sensor, a temperature sensor and/or another suitable sensor. The terms estimate, determine and calculate are used herein as synonyms.

The Examples of the more important features of a methods and apparatus for estimating loads downhole have been summarized rather broadly in order that the detailed description thereof that follows may be better understood, and in order that the contributions to the art may be appreciated. There are, of course, additional features that will be described hereinafter and which will form the subject of the claims. The summary provided herein is not intended to limit the scope of the claims in any way.

BRIEF DESCRIPTION OF THE DRAWINGS

The disclosure herein is best understood from the following detailed description referring to the drawings, in which same elements are generally referred by same numerals and wherein.

DETAILED DESCRIPTION

Figure 1:
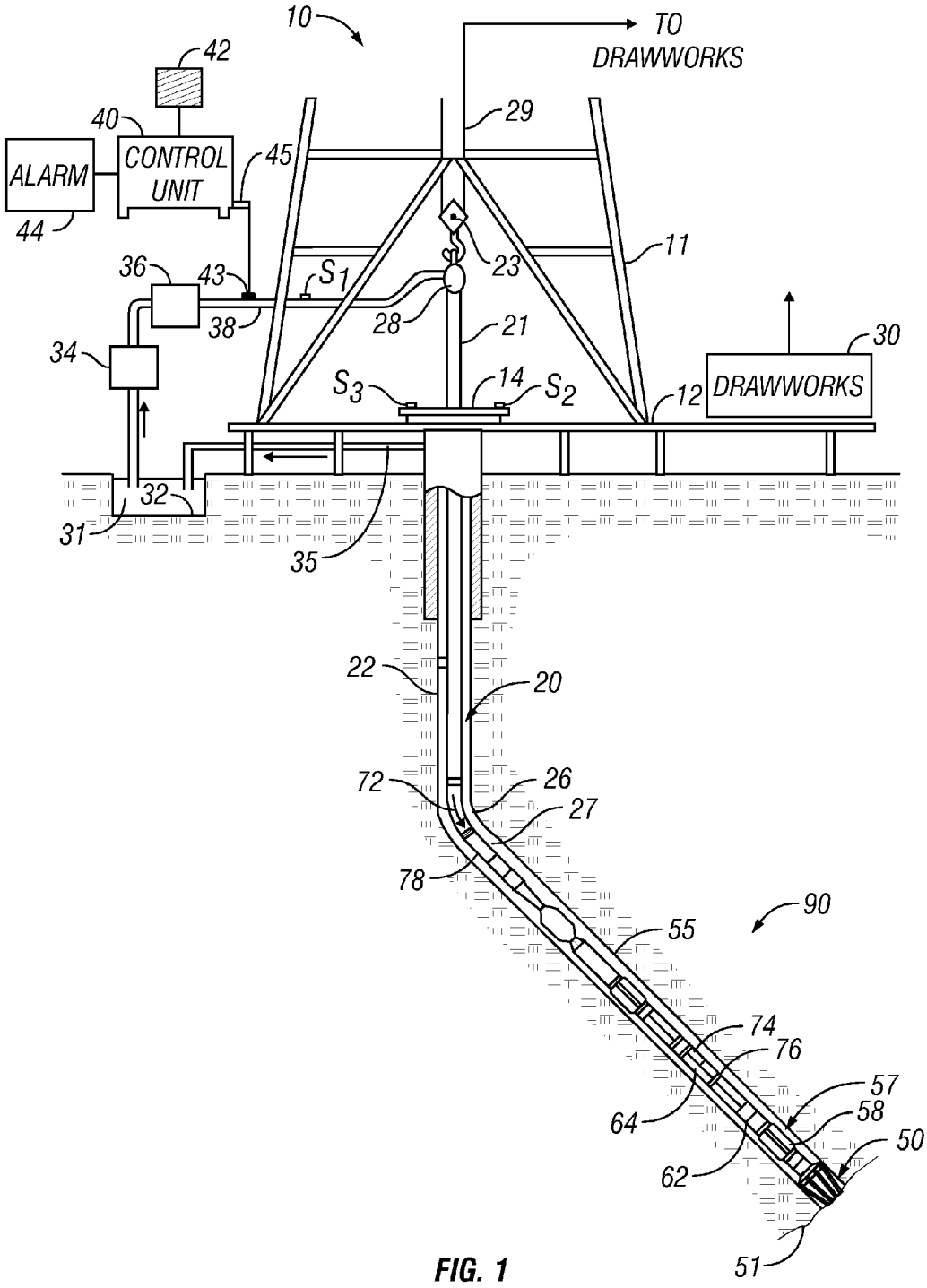
FIG. 1 shows a schematic diagram of a drilling system having a drill string containing a drilling assembly that includes measurement devices according to one embodiment of the disclosure.

FIG. 1 shows a schematic diagram of a drilling system 10 for estimating a property of interest of a tool downhole. The system includes a drill string 20 having a drilling assembly or BHA 90 conveyed in a borehole 26 for drilling a wellbore 20 in an earth formations 55. The drilling system 10 includes a conventional derrick 11 erected on a floor 12 that supports a rotary table 14 that is rotated by a prime mover, such as an electric motor (not shown), at a desired rotational speed. The drill string 20 includes a drill pipe 22 extending downward from the rotary table 14 into the borehole 26. A drill bit 50, attached to the end of the BHA 90, disintegrates the geological formations when it is rotated to drill the borehole 26. The drill string 20 is coupled to a drawworks 30 via a Kelly joint 21, swivel 28 and line 29 through a pulley 23. During the drilling of the wellbore, draw works 30 controls the weight on bit, which affects the rate of penetration.

During drilling operations, a suitable drilling fluid or mud 31 from a source or mud pit 32 is circulated under pressure through the drill string 20 by a mud pump 34. The drilling fluid 31 passes from the mud pump 34 into the drill string 20 via a desurger 36, fluid line 38 and the Kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A sensor $S_1$ in the line 38 provides information about the fluid flow rate. A surface torque sensor $S_2$ and a sensor $S_3$ associated with the drill string 20 respectively provide information about the torque and the rotational speed of the drill string. Additionally, one or more sensors (not shown) associated with line 29 are used to provide the hook load of the drill string 20 and information about other desired parameters relating to the drilling of the wellbore 26.

In some applications, the drill bit 50 is rotated by only rotating the drill pipe 22. However, in many other applications, a downhole motor 55 (mud motor) disposed in the drilling assembly 90 is used to rotate the drill bit 50 and/or to superimpose or supplement the rotational power. In either case, the rate of penetration (ROP) of the drill bit 50 into the borehole 26 for a given formation and a drilling assembly largely depends upon the weight on bit and the drill bit rotational speed.

In one aspect of the system of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the drill motor and the reactive upward loading from the applied weight on bit. A stabilizer 58 coupled to the bearing assembly 57 acts as a centralizer for the lowermost portion of the mud motor assembly.

A surface control unit 40 receives signals from the downhole sensors and devices via a sensor 43 placed in the fluid line 38 and signals from sensors $S_1$, $S_2$, $S_3$, hook load sensor and any other sensors used in the system and processes such signals according to programmed instructions provided to the surface control unit 40. The surface control unit 40 displays desired drilling parameters and other information on a display/monitor 42 that is utilized by an operator to control the drilling operations. The surface control unit 40 contains a computer, memory for storing data, recorder for recording data and other peripherals. The surface control unit 40 also includes a simulation model and processes data according to programmed instructions and responds to user commands entered through a suitable device, such as a keyboard. The control unit 40 is adapted to activate alarms 44 when certain unsafe or undesirable operating conditions occur. The use of the simulation model is described in detail later.

Referring back to FIG. 1, BHA 90 may also contain sensors and devices in addition to the above-described sensors. Such devices may include a resistivity device 64 for measuring the formation resistivity near and/or in front of the drill bit, a gamma ray device for measuring the formation gamma ray intensity and devices for determining the inclination and azimuth of the drill string. The resistivity device 64 may be coupled above the lower kick-off subassembly 62 that provides signals from which resistivity of the formation near or in front of the drill bit 50 is determined. An inclinometer 74 and gamma ray device 76 are suitably placed along the resistivity measuring device 64 for respectively determining the inclination of the portion of the drill string near the drill bit 50 and the formation gamma ray intensity. In addition, an azimuth device (not shown), such as a magnetometer or a gyroscopic device, may be utilized to determine the drill string azimuth. Such devices are known in the art and therefore are not described in detail herein. In the above-described configuration, the mud motor 55 transfers power to the drill bit 50 via a hollow shaft that also enables the drilling fluid to pass from the mud motor 55 to the drill bit 50. In an alternate embodiment of the drill string 20, the mud motor 55 may be coupled below a resistivity measuring device 64 or at any other suitable place.

Still referring to FIG. 1, other LWD devices, such as devices for measuring formation porosity, permeability and density, may be placed above the mud motor 64 in the housing 78 for providing information useful for evaluating the subsurface formations along borehole 26. For example, gamma rays emitted from a source enter the formation where they interact with the formation and attenuate. The attenuation of the gamma rays is measured by a suitable detector from which density of the formation is determined.

The above-noted devices transmit data to a downhole telemetry system 72, which in turn transmits the received data uphole to the surface control unit 40. The downhole telemetry system 72 also receives signals and data from the uphole control unit 40 and transmits such received signals and data to the appropriate downhole devices. The system 10, in aspect may utilize a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, other telemetry techniques, such as electromagnetic telemetry, acoustic telemetry or another suitable telemetry technique may also be utilized for the purposes of this invention.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled tubing for conveying the drilling assembly downhole. In such an application a thruster is sometimes deployed in the drill string to provide the desired force on the drill bit. For the purpose of this invention, the term weight on bit is used to denote the force applied to the drill bit during drilling operation, whether applied by adjusting the weight of the drill string or by thrusters or by any other method. Also, when coiled-tubing is utilized, the tubing is not rotated by a rotary table but instead it is injected into the wellbore by a suitable injector while the downhole motor, such as mud motor 55, rotates the drill bit 50. Also, for offshore drilling, an offshore rig or a vessel is used to support the drilling equipment, including the drill string.

In one aspect, the BHA 90 includes a sensor circuitry, programs and algorithms for providing information about various types of loads on the BHA 90 or a portion thereof. Such sensors, as explained later in reference to FIGS. 2-9, in one aspect, are magnetically coded contactless sensors configured to provide measurements for loads on one or more sections or members of the BHI. The load may be an axial load (such as a compression load or a tensile load), a torsional load or a bending load. Such sensors may be disposed at any suitable locations in the BHA 90, including a steering unit 58. The load measurements, in one aspect, may be utilized to estimate or determine one or more parameters of interest, such as weigh on bit (WOB), bending or bending moment, or torque. The load measurements may be used directly or indirectly to operate a device in the BHA, such as the steering unit 58, for example to drill the wellbore along a particular path, to maintain the drilling direction along a selected path, or to determine wear on certain members of the BHA, such as a bearing assemblies, etc.

In another aspect, the BHA 90 may include magnetic coded sensors that may be configured to measure displacement (movement) of one member relative to another member or a fixed point. The displacement may be a linear or axial movement, rotational movement or a bending movement. The displacement measurements may be used to determine and adjust a force applied by a rib or force application member of a steering mechanism to drill the well along a particular path or to estimate a parameter relating to the BHA, such as rotational speed of a member, angular movement of a member, etc. The term load or loads used herein includes, but is not limited to, bending loads, torque loads, and axial loads (compressional and tensile loads). The determination of such loads, as noted above, allows for the determination of drilling parameters such as BHA side forces, drill bit side forces, weight on bit (WOB), and drilling motor and drill bit conditions and efficiencies. The load and/or displacement measurement signals may be processed downhole and/or at the surface to determine the relative value or severity of parameters related to such measurements. The downhole information may be sent to the surface control unit 40 via a suitable telemetry system 72. The terms estimate, determine and calculate are used as synonyms.

Figure 2:
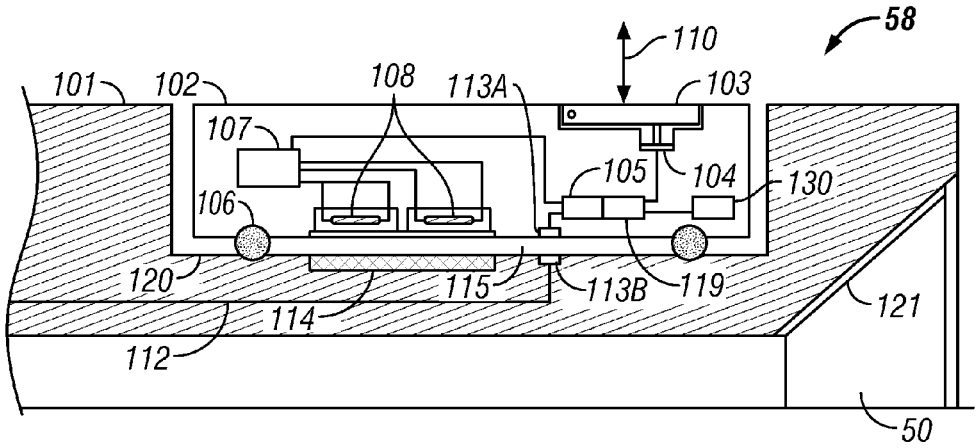
FIG. 2 shows a longitudinal cross-section of a portion of a drilling assembly having a non-rotating sleeve around a magnetically encoded rotating member that may be utilized as one embodiment for estimating a parameter of interest.

FIG. 2 shows a cross section of a portion 58 of the drilling assembly 90 that includes a rotating member 101 that rotates when the drill string 22 (see FIG. 1) is rotated. In the configuration of FIG. 1, member 101 transmits torque, bending, loading, axial loading and WOB through threaded connection 121 to drill bit 50. In one embodiment, member 101 is a tubular member having a reduced diameter section 120. A non-rotating or substantially non-rotating sleeve or housing 102 surrounds the reduced diameter section 120 and is rotationally disengaged from member 101 by virtue of bearings 106 installed in appropriate grooves in member 101 and housing 102. Gap 115 is maintained between reduced diameter section 120 and housing 102 by bearings 106. In one embodiment, gap 115 is unsealed and may be filled with the drilling fluid. In another aspect, gap 115 may be sealed and filled with a suitable fluid.

Reduced diameter section 120 has coded or encoded magnetic field 114 induced along more segments thereof such that loads on member 101 alter the orientation of magnetic flux lines of magnetic field 114. The magnetization of coded magnetic field section 120 may be done by using any suitable technique, including but not limited to encoding methods shown in U.S. Pat. Nos. 6,904,814, 6,581,480 and U.S. Patent Application No. 2005/0193834A1, which is incorporated herein by reference. The coded magnetic field's depth, pattern and dimensions may be determined based on the particular application and the nature of the downhole environment.

Generally, the term "coded or encoded magnetic field" herein means a member that is magnetized for a particular purpose. Magnetic field 114 extends outward from section 120. Changes in magnetic field 114, caused by loading of member 101 are detected by one or more sensors placed proximate the magnetic encoded field. These measurements are related to the loading imposed on member 101. Different orientations of sensors 108 provide for determination of different loading types, as discussed later in reference to FIGS. 7-9. Multiple sensors 108, having different orientations, may be employed in the same assembly for determining different types of loads at the same time. Sensors 108, in one embodiment, include inductor coils sized to detect the changes in the magnetic field caused by the loading on member 101.

The controller 105 processes the signals for circuitry 107 to determine one or more parameters of interest for such signals. The sensor system that includes sensors 108 includes an electronic module or circuitry 107 that receives output signals from sensors 108 and provides the signals to a controller 105 that may process the received signals to provide information relating to one or more parameters of interest, such as weight on-bit, torque, azimuthal or axial displacement, bend, bending moment, RPM, etc. The controller 105 as described in more detail with respect to FIG. 6 may include a processor, memory and related circuitry and programs or programmed instructions. The controller 105, in one aspect, may transmit the information or data via a sensor arrangement to 113*a* and 113*b* that may include an inductive coupling or slip ring arrangement to transfer data and power between the rotating member and non-rotating member 101. Thus, the sensor arrangement shown in FIG. 1 is a dynamic arrangement wherein the magnetic coded section rotates with respect to a non-rotating sensor or detector. The location of the magnetic coded section and the sensors 108 may be reversed.

In another aspect, the controller 105 may operate or control a downhole device in response to the measurements made by the downhole magnetic sensor arrangement. For example, the controller may control a force application member to change drilling direction, such as shown in FIG. 2. FIG. 2 shows a force application member or rib 103 that is pivotally attached to the member 102 and is adapted to move between a retracted position and an extended position (radially outward) as shown by the arc 110. A hydraulic unit 119 that includes a motor and pump drives a piston arrangement 104 to cause the rib 103 to move from the retracted position (shown) to an extended position. The controller 105 controls the hydraulic unit 119 to cause the rib 103 to apply a desired force on the wellbore wall. The BHA typically may include three or more ribs 103 and they may be independently controlled by one or more controllers 105. The system of FIG. 2 may further include one or more secondary sensors to provide measurements relating to drilling assembly parameters, such as direction of the BHA and/or formation parameter, such as resistivity, porosity, density, pressure, etc. The controller 105 may utilize one or more of the drilling and/or formation parameters to operate or control a downhole device in response to or based on the measurements of the magnetic sensor arrangement of the present disclosure. In one aspect, the above-described system provides a closed-loop drilling system that may be used to control the drilling direction of the wellbore 26 by controlling, e.g. the bend of the member 101 based on the measurements from the sensor arrangement (108, 114).

Figure 7:
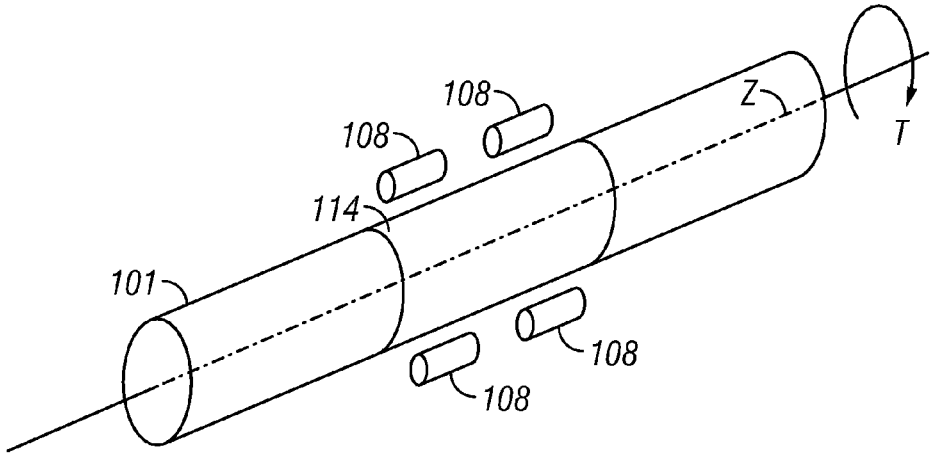
FIG. 7 shows a sensor arrangement for estimating or determining torque on a member downhole according to one embodiment of the disclosure.

Referring to FIG. 2 and FIGS. 7-9 various arrangements of magnetic sensors are shown for measuring different types of loads on member 101. FIG. 7 shows an arrangement suitable for measuring torque on member 101. A pair of sensors 108 are aligned along an axis that is substantially parallel to the longitudinal z-axis of member 101. In one embodiment, multiple pairs of sensors 108 may be located around member 101. Sensor pairs are positioned to detect the flux lines in magnetic field 114. Torque "T" on member 101 causes a related change in magnetic field 114 that is detected by sensors 108 and transmitted to controller 105, as described above.

Figure 8:
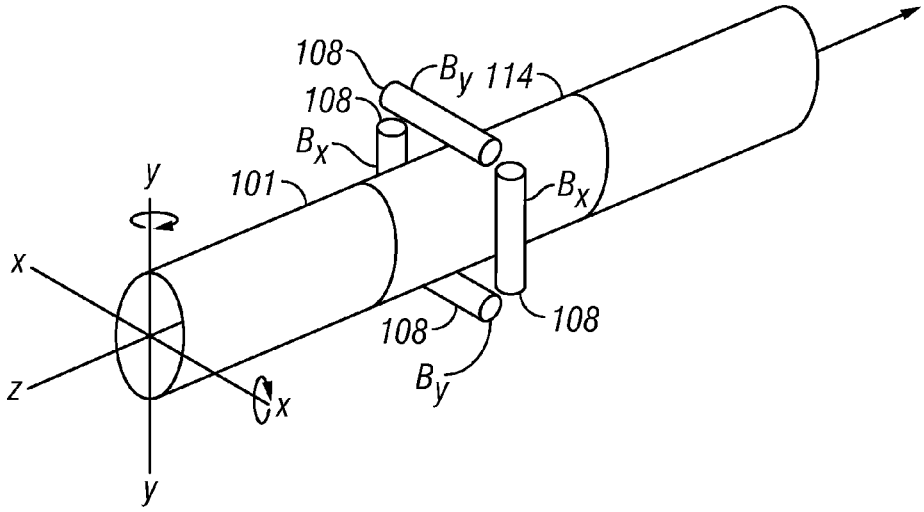
FIG. 8 shows a sensor arrangement for estimating or determining bending on a member downhole according to one embodiment of the disclosure.

FIG. 8 shows an arrangement of sensors 108 suitable for measuring bending in both the "x" and "y" axes on member 101. As shown, in one embodiment, sensors 108 are located in an x-y plane that is substantially perpendicular to the longitudinal z-axis of member 101. Sensors 108 are mounted in pairs $B_x$ and $B_y$ on opposite sides of member 101, for measuring the corresponding bending about the X and Y axes. The $B_x$ and $B_y$ components may be suitably combined to determine the actual vector orientation of the bending of member 101. Sensors 108 are substantially tangential to the outer surface of member 101. Bending of member 101 causes a related change in the magnetic field 114 that is detected by sensors 108 and transmitted to controller 105, as described above.

Figure 9:
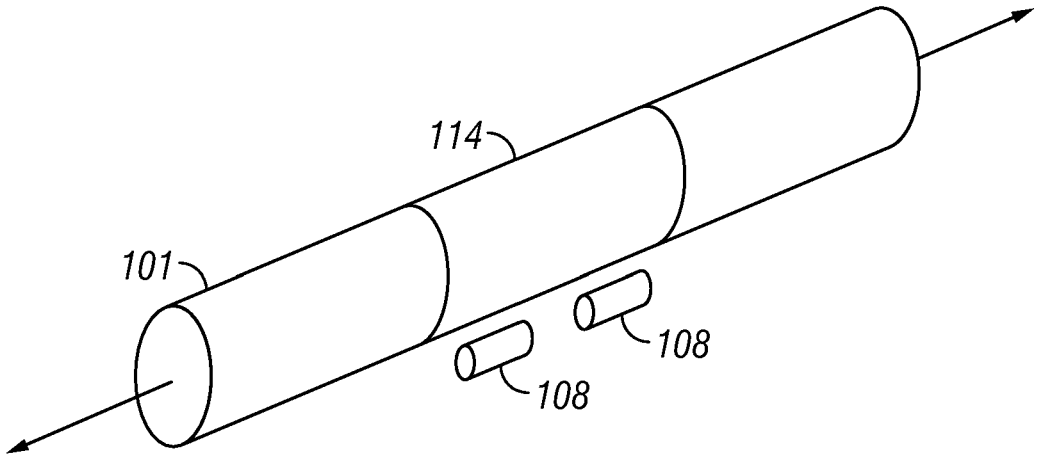
FIG. 9 shows a sensor arrangement for estimating or determining bending on a member downhole according to another embodiment of the disclosure.

FIG. 9 shows an arrangement suitable for measuring axial strain of member 101 relative to sensors 108. The axial strain is indicative of load on member 101 and may be further related to WOB. Two sensors 108 are aligned, spaced apart, along an axis that is substantially parallel to the longitudinal axis Z of member 101. Changes in axial loading of member 101 causes a related change to magnetic field 114 that is detected by sensors 108 and the signal transmitted to controller 105, as described above.

As previously discussed, the arrangements of sensors in FIGS. 7-9 are shown separately for clarity. It is intended that the disclosure herein encompass any combination of sensor arrangements for measuring one or more of the loadings on member 101 or movement of one member relative to another member.

Figure 3:
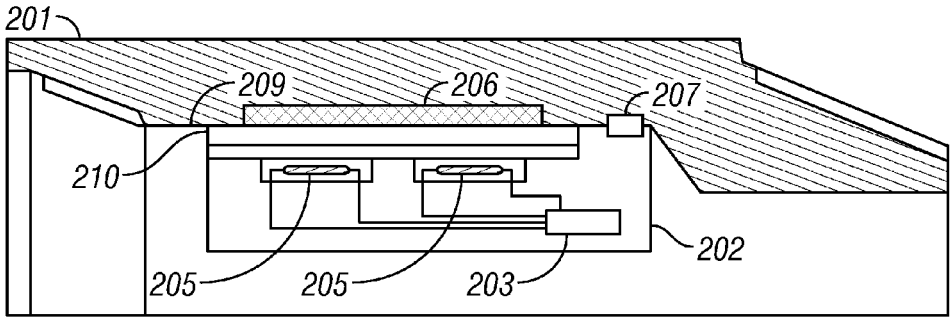
FIG. 3 shows a longitudinal cross-section of a portion of a drilling assembly having a magnetically encoded member and an a housing disposed therein according to another embodiment that may be utilized for estimating a parameter of interest.

FIG. 3 shows another embodiment, in which both drill string sub 201 and sensor insert 202 are fixed to rotate together by key 207 which engages both sub 201 and insert 202. Any suitable method of fixing sub 201 to insert 202 may be used for purposes of this invention. An arrangement wherein the two members carrying the sensor arrangements are attached is referred to herein as the static arrangement. In this embodiment, inner surface 209 has an encoded magnetic field 206 induced on an axial length thereof, such that loads on sub 201 alter the orientation of magnetic flux lines of magnetic field 206. Changes in magnetic field 206 caused by loading of sub 201 are detected by sensors 205. Different orientations of sensors 205, similar to those discussed previously with respect to FIGS. 7-9, provide for determination of different loading types. Sensor insert 202 is separated by gap 210 from sub 201 over at least an axial length of magnetic field 206. Coil interface electronics 203 relate the detected changes in magnetic field 206 to loads on sub 201 due to the controller, such as controller 105 described above with respect to FIG. 2. The load data are transmitted over conductors (such as conductor 112 (FIG. 2) to telemetry system 72 in the BHA for transmission to surface controller 40.

Figure 4:
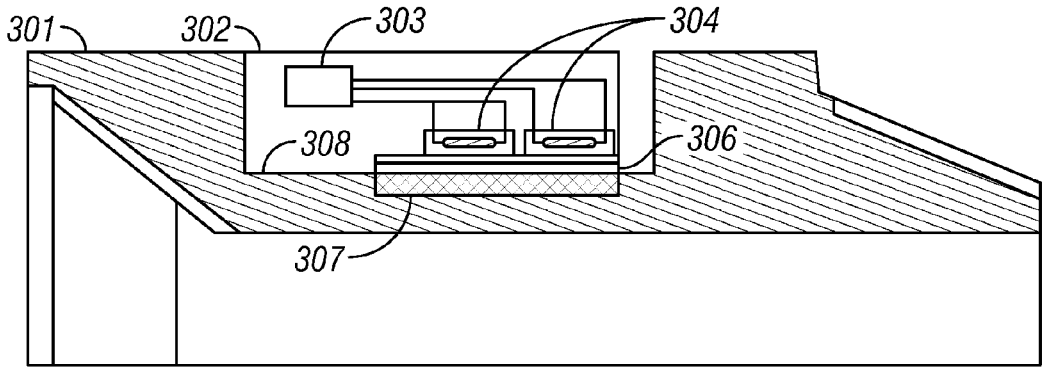
FIG. 4 shows a longitudinal cross-section of a portion of a drilling assembly having a magnetically encoded section and a housing around the magnetically encoded section according to another embodiment that may be utilized for estimating a parameter of interest.

In another embodiment, see FIG. 4, sensor module 302 rotates with member 301. Member 301 has a reduced diameter section 308 having an encoded magnetic field 307 induced on an axial length thereof, such that loads on member 301 alter the orientation of magnetic flux lines of magnetic field 307. Changes in magnetic field 307, caused by loading of member 301, are detected by sensors 304 and related to the loading imposed on member 301. Different orientations of sensors 304, similar to those discussed previously with respect to FIGS. 7-9, provide for determination of different loading types. Sensor module 302 is separated by gap 306 from member 301 over at least the axial length of magnetic field 307. Coil interface electronics 303 relate the detected changes in magnetic field 307 due to loads on member 301 to the downhole controller, such as shown controller 105 (FIG. 2). The load data are transmitted over conductors (such as 112, FIG. 2) to telemetry system 72 for transmission to surface controller 40. Sensor module 302 may be a clamshell arrangement surrounding member 301. Alternatively, multiple sensor modules 302 may be fixed in axially elongated pockets formed in the external surface of member 301. Also, alternatively, the magnetic coding 306 may be done on member 301 while the sensors 304 and related circuitry etc. may be placed on member 302.

Figure 5A:
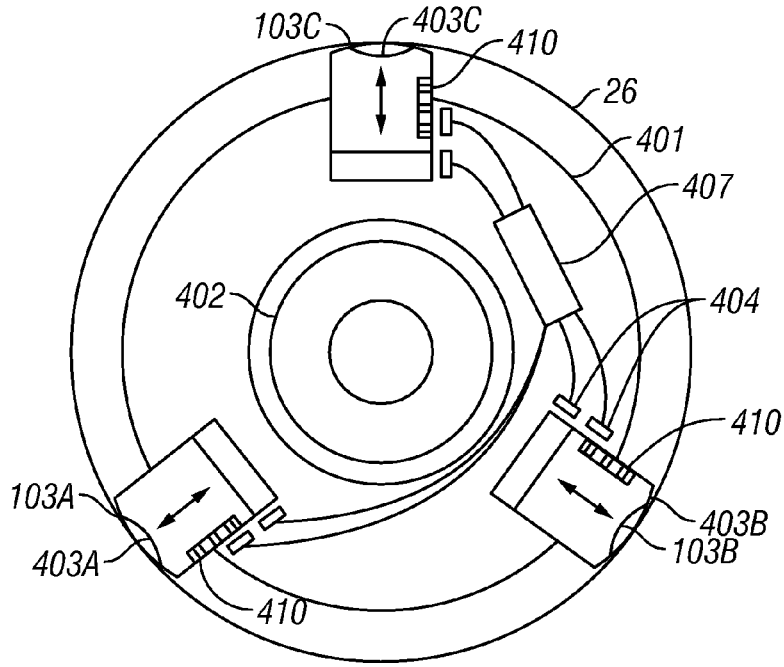
FIG. 5A shows a sensor for estimating or determining movement of a member according to one embodiment of the disclosure.

FIG. 5A shows an exemplary arrangement for measuring movement of one member 401 with respect to another member 402 in a downhole tool. FIG. 5A shows three pistons 403*a-c* that are adapted to move independently between their respective retracted positions and extended positions. Each piston 403 causes its respective rib 103 to move accordingly. In one embodiment, the pistons 403*a*-403*c* may be instrumented or configured to determine the position of each arm relative to an unenergized position. By determining the position of arms 103*a*-103*c*, the diameter of the borehole maybe determined at any suitable borehole depth. Thus, the sensor arrangement may be used as a caliper for in-situ measurements of the internal dimensions of the borehole 26.

As shown in FIG. 5A, surface 410 of each piston member 403 is magnetized with an encoded magnetic field. When powered, the piston 403 moves radially outward. Sensors 404 detect the movement of piston 403. The movement of the pistons 403 relate to the position of the ribs 103 (see FIG. 2). The signals from sensors 404 may be processed by the controller 407 or sent uphole for processing. The controller 407, using the movement measurements of pistons 403 can determine the inside diameter of the borehole 26.

In another embodiment, the sensor arrangement similar to one shown in FIG. 5A may be used to determine relative movement between any two members.

Figure 5B:
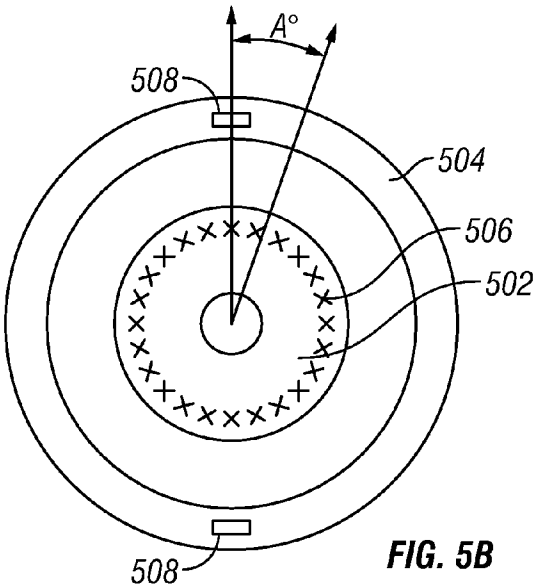
FIG. 5B shows a sensor for estimating or determining movement of a rotating member according to another embodiment of the disclosure.

In another aspect, the sensor arrangement according to one embodiment may be used to determine angular displacement of a member. FIG. 5B shows a member 502 that rotates relative to another member 504. The rotating member 502 may include a magnetically coded filed 506 and the other member 504 may include one or more sensors 508. The sensors 508 provide signals that correspond to the movement of member 502 relative to the sensors 508. These measurements may be used to determine the angular displacement of member 502 relative to member 504 and to determine the rotational speed (RPM). A controller, similar to controller 105 described with respect to FIG. 2, may be used for processing sensor 508 signals. The position data are transmitted over conductors (e.g. conductors 112, FIG. 2) to telemetry system 72 for transmission to surface controller 40.

Figure 6:
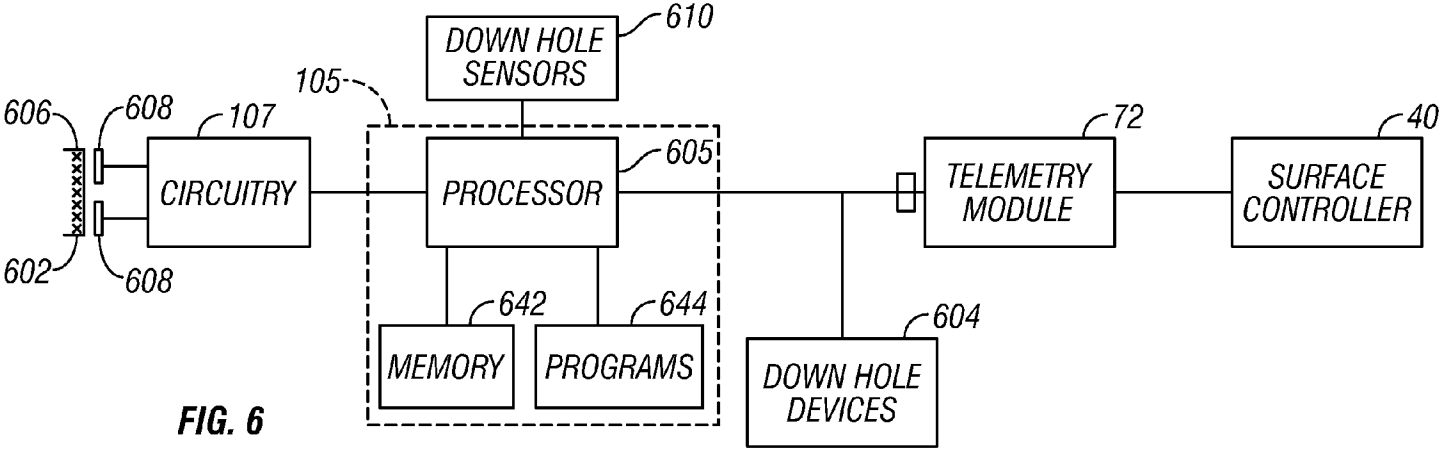
FIG. 6 shows a block diagram of a system for estimating or determining loads on a member downhole and communicating information relating thereto to a surface controller according to one embodiment of the disclosure.

FIG. 6 shows a block diagram of a system for determining loads on a downhole assembly and/or movement of a member of a downhole assembly, communicating the load information to a surface controller and/or to perform a downhole operation. The system of FIG. 6 shows an optional circuitry 107 that may include amplifiers and other components to condition signals from sensors 608 responsive to changes in the magnetic field received by the sensors 608. A processor 605 of the controller 105 processes the conditioned or direct signals from the sensors 608 to determine the load on the member 602 or movement of the member 602 relative to the sensors 608. The controller includes a memory 642 (computer-readable media) for storing therein. The data from the processor programs 644 provides executable instructions to the processor 605, which when executed perform the methods described herein. The processor 605 also may receive information from one or more sensors 610, such as directional sensors, sensors that provide a drilling parameter or a parameter of the formation.

The processor 605 in one aspect transmits information to the surface controller via a downhole telemetry module 72. The processor also receives signals, including command and control signals from the surface controller 40 and in response thereto performs the desired functions, including controlling devices 604. The processor may control a device, such as a steering device to control the drilling direction, operate a valve or other activity device to control flow of fluid through a device downhole, etc. In any case, the process uses information obtained from the magnetic coded sensor arrangement (606, 608) at least in part, to perform the described functions.

Thus, an apparatus for measuring loads on a member downhole may include a magnetic field encoded section. A sensor detects a change in the magnetic field due to a load on the member. The sensor may include at least one coil proximate the magnetic field encoded section. In one embodiment, the member may be a rotating member and the sensor may be located in or on non-rotating member. The rotating member may drive a drill bit for drilling a wellbore. In one embodiment, the apparatus may further include a controller having a processor and a memory that determines the load on the member from the detected change in the magnetic field. The load on the member may be: (i) torque; (ii) bending; (iii) weight on bit; and/or (iv) an axial movement.

A method for estimating a load on a member in a wellbore may include: encoding a magnetic field along a section of the member; and detecting a change in the magnetic field due to a load on the member downhole. The method and apparatus may be used to activate or operate a device downhole, such as a device to steer a drilling assembly to drill a wellbore along a desired path. In another aspect, angular movement of members may be determined by using one or more magnetic coded sensor arrangements. The angular movement may include a measurement of displacement or movement of one member relative to another member or relative to a fixed position, rotational speed of a member, etc.

While the foregoing disclosure is directed to the described embodiments of the invention, various modifications will be apparent to those skilled in the art. It is intended that all variations of the appended claims be embraced by the foregoing disclosure. The abstract is provided to meet certain filing requirements and is not intended to limit the scope of the claims in any manner.

What is claimed is:

1. A method of estimating a load relating to an operation of a tool in a wellbore, comprising:

magnetizing one of a member of the tool and a sleeve surrounding the member and rotationally disengaged from the member to have a coded magnetic field section therein;

disposing a sensor radially opposite the coded magnetic field in the other of the member and the sleeve;

conveying the tool in the wellbore;

detecting a change in the coded magnetic field with the sensor when the tool experiences a load in the wellbore;

estimating the load on the tool using the detected change in the coded magnetic field; and recording the estimated load on a suitable medium.

2. The method of claim 1 further comprising using the estimated load to estimate a parameter of interest that is selected from a group consisting of: weight on drill bit; axial movement; radial movement; displacement; and an inside dimension of the wellbore.

3. The method of claim 2, wherein detecting the change in the coded magnetic field comprises detecting displacement of the coded magnetic field relative to the sensor proximate the coded magnetic field and wherein the parameter of interest is movement of the member relative to a selected point.

4. The method of claim 3, wherein the coded magnetic field and the sensor are arranged in a manner that is selected from the group consisting of: the coded magnetic field section is on the member that moves and the sensor is at a position that is fixed relative to member; and the coded magnetic field section is on the member that is fixed and the sensor moves relative to the member.

5. The method of claim 1, further comprising detecting the change in the coded magnetic field during drilling of the wellbore.

6. The method of claim 1 further comprising processing signals representative of the change in the coded magnetic field using a processor that is placed at a location selected from the group consisting of: within the tool; and at a surface location.

7. An apparatus for use in a wellbore, comprising:

a member of the apparatus;

a sleeve surrounding the member and rotationally disengaged from the member, wherein one of the member and the sleeve is magnetized to have a coded magnetic field section therein;

a sensor radially opposite the coded magnetic field section configured to detect a change in the coded magnetic field when the apparatus experiences the load in the wellbore and provide a signal representative of the detected change; and a processor configured to process the signals to estimate a load on the apparatus.

8. The apparatus of claim 7, wherein the processor is further configured to use the load to determine a parameter of interest selected from the group consisting of: load; movement or displacement; and weight on drill bit.

9. The apparatus of claim 7, wherein the sensor includes at least one coil proximate the coded magnetic field section with a gap between the coil and the coded magnetic field section.

10. The apparatus of claim 7, wherein the apparatus includes a drilling assembly and wherein the member is configured to rotate relative to the sensor during drilling of the wellbore by the drilling assembly.

11. The apparatus of claim 7 further comprising a data storage device that has embedded therein programmed instructions accessible to the processor and wherein the processor is configured to utilize the programmed instructions to estimate the load.

12. The apparatus of claim 7 further comprising a telemetry unit that is configured to transmit data relating to the load to the surface during an operation of the apparatus in the wellbore.

13. The apparatus of claim 7, wherein the processor is configured to cause the apparatus to perform an operation in the wellbore based at least in part on a measurement made by the sensor.

14. The apparatus of claim 13, wherein the operation is selected from a group consisting of: (i) applying force to a wall of the wellbore during drilling of the wellbore using the apparatus to drill the wellbore along a desired trajectory; and (ii) altering rotation of a drill bit carried by the apparatus during drilling of the wellbore.

15. A wellbore apparatus comprising:

a section of the apparatus having a longitudinal axis, the section magnetized to have a coded magnetic field along the section; and a sleeve surrounding the section and rotationally disengaged from the section, the sleeve having a sensor radially opposite the coded magnetic field configured to measure a change in the coded magnetic field when one of the section and sensor moves relative to the other in a wellbore under a load.

16. The apparatus of claim 15, wherein the movement of one of the section and the sensor corresponds to a movement selected from a group consisting of: a linear movement; an angular movement; and a movement along a non-linear path.

* * * * *